US009670890B2

(12) United States Patent
Limmer et al.

(10) Patent No.: US 9,670,890 B2
(45) Date of Patent: Jun. 6, 2017

(54) FUEL INJECTOR

(71) Applicant: DELPHI INTERNATIONAL OPERATIONS LUXEMBOURG S.a.r.l., Bascharage (LU)

(72) Inventors: Andrew J. Limmer, Lawshall (GB); Christopher S. Hardy, London (GB); Joseph M. Luck, London (GB)

(73) Assignee: Delphi Inernational Operations Luxembourg S.A.R.L., Luxembourg (LU)

( * ) Notice: Subject to any disclaimer, the term of this patent is extended or adjusted under 35 U.S.C. 154(b) by 257 days.

(21) Appl. No.: 14/371,260

(22) PCT Filed: Jan. 14, 2013

(86) PCT No.: PCT/EP2013/050535

§ 371 (c)(1),
(2) Date: Jul. 9, 2014

(87) PCT Pub. No.: WO2013/104782

PCT Pub. Date: Jul. 18, 2013

(65) Prior Publication Data

US 2015/0000637 A1 Jan. 1, 2015

(30) Foreign Application Priority Data

Jan. 13, 2012 (EP) ..... 12151087

(51) Int. Cl.
*F02M 69/04* (2006.01)
*F02M 61/10* (2006.01)
(Continued)

(52) U.S. Cl.
CPC ..... *F02M 69/048* (2013.01); *F02M 47/027* (2013.01); *F02M 63/0035* (2013.01); *F02M 63/0047* (2013.01); *F02M 2200/28* (2013.01)

(58) Field of Classification Search
CPC .... F02M 47/027; F02M 43/04; F02M 45/086; F02M 63/0225; F02M 2200/46;
(Continued)

(56) References Cited

U.S. PATENT DOCUMENTS 6,168,087 B1 1/2001 Cooke
6,471,142 B1 * 10/2002 Lambert ..... F02M 45/08 239/88
(Continued)

FOREIGN PATENT DOCUMENTS

DE 10 2007 010498 A1 9/2008
EP 1 541 860 B1 7/2007
(Continued)

OTHER PUBLICATIONS

International Search Report dated Apr. 9, 2013.

*Primary Examiner* — Long T Tran
(74) *Attorney, Agent, or Firm* — Joshua M. Haines

(57) ABSTRACT

A fuel injector comprises a supply means for high pressure fuel, an injection nozzle including a valve needle engageable with a valve needle seating to control fuel delivery from the injector, a first filling flow path providing flow from the supply means into a control chamber, and a control valve for controlling fuel pressure within the control chamber. The control valve comprises a control valve member slidable within a guide bore of a valve housing. The injector further comprises a drain flow path including a drain restriction and permitting flow from the control chamber to a second valve chamber when the control valve member is in a second state, and a second filling flow path permitting flow from a first valve chamber into the control chamber when the control valve member is in a first state, wherein the second filling flow path bypasses the drain restriction.

15 Claims, 4 Drawing Sheets

(51) Int. Cl.
*F02M 63/00* (2006.01)
*F02M 47/02* (2006.01)

(58) Field of Classification Search
CPC ..... F02M 63/0045; F02M 63/0015; F02M 63/004; F02M 51/06; F02M 55/002; F02M 55/02; F02M 61/10; F02M 61/167; F02M 63/0017; F02M 21/0257; F02M 2200/315; F02M 21/023; F16K 11/044
USPC ..... 123/445–457; 239/567–572, 239/633.1–533.5, 88, 96
See application file for complete search history.

(56) References Cited

U.S. PATENT DOCUMENTS 7,950,593 B2 * 5/2011 Wang ..... F02M 47/027 123/446
8,333,178 B2 * 12/2012 Harcombe ..... F02M 47/027 123/506
8,342,423 B2 * 1/2013 Bowers ..... F02M 47/027 123/446
2005/0133629 A1 * 6/2005 Stringfellow ..... F02M 47/027 239/533.2
2005/0173563 A1 * 8/2005 Coldren ..... F02M 63/0007 239/533.1
2007/0199539 A1 * 8/2007 Lennox ..... F02D 19/0628 123/304
2009/0072054 A1 * 3/2009 Bowers ..... F02M 47/027 239/569
2009/0165751 A1 * 7/2009 Harcombe ..... F02M 47/027 123/506
2013/0081593 A1 * 4/2013 Coldren ..... F02M 63/0045 123/304
2013/0098333 A1 * 4/2013 Kim ..... F02M 43/04 123/445
2013/0153686 A1 * 6/2013 Keeler ..... F02M 63/0054 239/584

FOREIGN PATENT DOCUMENTS

EP 1 835 171 B1 3/2008
EP 1 604 104 B1 8/2008
EP 2 022 975 A1 2/2009
EP 1 988 276 B1 3/2011
JP 2000-130614 A 5/2000

* cited by examiner

FUEL INJECTOR

CROSS REFERENCE TO RELATED APPLICATIONS

This application is a national stage application under 35 U.S.C. 371 of PCT Application No. PCT/EP2013/050535 having an international filing date of 14 Jan. 2013, which designated the United States, which PCT application claimed the benefit of European Patent Application No. 12151087.9 filed on 13 Jan. 2012, the entire disclosure of each of which are hereby incorporated herein by reference.

FIELD OF THE INVENTION

The present invention relates to a fuel injector for use in the delivery of fuel to a combustion space of an internal combustion engine, and particularly to a fuel injector suitable for accurately delivering small quantities of fuel.

BACKGROUND TO THE INVENTION

To optimise diesel engine combustion, it is necessary to have precise control over the quantities of fuel delivered by the fuel injectors. It is desirable to be able to inject small quantities of fuel across a wide range of fuel pressures. For heavy-duty applications in particular, the fuel injectors must be capable of delivering fuel in small quantities at very high fuel pressures. Furthermore, to meet increasingly stringent emissions targets, it is desirable that the timing of each injection and the quantity of fuel delivered with each injection can be controlled with great accuracy.

Typically, a fuel injector includes an injection nozzle having a valve needle which is movable towards and away from a valve needle seating so as to control fuel injection into the engine. The valve needle may be controlled by means of a nozzle control valve, which controls fuel pressure in a control chamber for the valve needle.

In one known type of injector, the nozzle control valve includes a control valve member which is moveable between a first position, in which fuel under high pressure is able to flow into the control chamber, and a second position in which the control chamber communicates with a low-pressure fuel reservoir, such as a low-pressure fuel drain. A surface associated with the valve needle is exposed to fuel pressure within the control chamber such that the pressure of fuel within the control chamber applies a force to the valve needle to urge the valve needle against its seating.

In order to commence injection, the nozzle control valve is actuated such that the control valve member is moved into its second position, thereby causing fuel pressure within the control chamber to be reduced. The force urging the valve needle against its seating is therefore reduced and fuel pressure within the delivery chamber serves to lift the valve needle away from its seating to permit fuel to flow through the injector outlet. In order to terminate injection, the valve arrangement is actuated such that the control valve member is moved into its first position, thereby permitting fuel under high pressure to flow into the control chamber. The force acting on the valve needle due to fuel pressure within the control chamber is therefore increased, causing the valve needle to be urged against its seating to terminate injection.

Small and accurately controllable injection quantities can be achieved by reducing the opening rate of the valve needle whilst maintaining a high closing rate. In other words, an asymmetric control arrangement is desired, in which the pressure in the control chamber decreases relatively slowly to achieve a controlled needle lift when the control valve member is moved into its second position, but increases relatively quickly to terminate injection rapidly when the control valve member is moved into its first position.

One way of achieving an asymmetric opening and closing characteristic is to provide an additional, direct flow path for supplying high-pressure fuel to the control chamber. This additional flow path is not under the control of the control valve, and serves to increase the pressure in the control chamber more rapidly during needle closure. Such arrangements are described in EP 1 541 860 B and EP 1 988 276 B.

Another way of achieving an asymmetric opening and closing characteristic is to modify the nozzle control valve to define a restricted flow path for fuel flow between the control chamber and a low pressure drain.

EP 1 604 104 B and EP 1 835 171 B describe restricted flow path arrangements that achieve asymmetric control. In each case, a restricted flow path is provided in the form of an annular clearance between the outer surface of the control valve member and the internal surface of the bore within which the control valve member is received. The restricted flow path restricts the rate of flow of fuel from the control chamber to the low-pressure drain, and therefore damps the opening movement of the valve needle, but does not hinder the re-filling of the control chamber with high-pressure fuel to allow rapid needle closure.

For increased emissions control, fuel injection strategies increasingly include multiple small pre- and/or post-injections of short duration and low volume, and it is desirable to increase further the ability of fuel injectors to deliver such short injections accurately. One problem with existing control valve arrangements utilising drain restrictions in the form of clearances between parts is that, due to manufacturing tolerances, it is relatively difficult to ensure that the cross-sectional area of the restricted flow path is accurately and consistently dimensioned during manufacture. Furthermore, in use, the cross-sectional area of the restricted flow path tends to vary with temperature, resulting in inconsistent operation.

There is also a trend towards increasing fuel injection pressures, for example to increase fuel atomisation and penetration. For this reason, fuel may be supplied to the injector at very high pressures (of the order of 3000 bar or more). The fuel pressure in the control chamber and in the associated passages can therefore approach or reach this high pressure when the valve needle is closed. When the valve needle is open, the fuel pressure in the control chamber and the associated passages drops significantly. Accordingly, it is desirable to ensure that the injector and, in particular, the passages associated with the control chamber, are able to withstand cyclical high-pressure loading. Furthermore, it is also desirable to reduce the risk of component damage due to cavitation and other fluid-flow effects that may occur as the high-pressure fuel in the control chamber is released to drain.

It is also desirable to reduce the part count and manufacturing complexity of fuel injectors to reduce cost and improve reliability.

Against this background, it would be desirable to provide a fuel injector having a control valve arrangement which allows more accurate control of the valve needle movement, whilst minimising part count and manufacturing complexity and reducing the risk of injector failure.

SUMMARY OF THE INVENTION

From a first aspect, the present invention resides in a fuel injector for use in a fuel system for an internal combustion engine, the fuel injector comprising a supply means for high pressure fuel, an injection nozzle including a valve needle which is engageable with a valve needle seating to control fuel delivery from the injector, a surface associated with the valve needle being exposed to fuel pressure within a control chamber, a first filling flow path providing flow from the supply means into the control chamber, and a control valve for controlling fuel pressure within the control chamber.

The control valve comprises a valve housing that defines, in part, a first valve chamber and a second valve chamber, and a control valve member slidable within a guide bore of the valve housing and operable between a first state in which the first valve chamber communicates with the supply means and in which flow between the second valve chamber and a low-pressure drain is prevented, and a second state in which flow between the first valve chamber and the supply means is prevented and in which the second valve chamber is in communication with the low-pressure drain.

The fuel injector further comprises a drain flow path that includes a drain restriction and permits flow from the control chamber to the second valve chamber when the control valve member is in the second state, and a second filling flow path that permits flow from the first valve chamber into the control chamber when the control valve member is in the first state. The second filling flow path bypasses the drain restriction and the drain flow path and the second filling flow path are formed within the valve housing.

Because the drain flow path and the second filling flow path are formed in the valve housing in which the control valve member is slidable, the part count and manufacturing complexity of the fuel injector can be minimised.

In a preferred embodiment, the injector further comprises a housing body having a mating surface that abuts the valve housing, and an end region of the control valve member is engagable with the mating surface of the housing body to prevent flow between the second valve chamber and the low-pressure drain when the control valve member is in its first state. In such an arrangement, the housing body may apply a compressive force to a region of the valve housing, such that the drain flow path and the second filling flow path can be formed within the region of the valve housing to which the compressive force is applied. In this way, the risk of failure of the injector due to rupture or cracking around the drain flow path and the second filling flow path is minimised, and the injector can be operated at higher injection pressures.

The drain restriction preferably comprises an orifice. By providing the drain restriction as an orifice, the flow area of the orifice and therefore the extent to which flow through the drain flow path is restricted when the control valve member is in its second state can be very precisely controlled during manufacture, improving the accuracy of the injector and the consistency of performance part-to-part. Furthermore, the pressure drop through an orifice is relatively insensitive to temperature, so by providing the drain restriction in the form of an orifice, the variation of injector performance with temperature changes in use can be minimised.

It will be understood that the term 'orifice' is intended to refer to a passage, drilling, bore or similar feature having a precisely-defined diameter and therefore a precisely-defined cross-sectional area for fluid flow therethrough. For example, the orifice may be a restricted-diameter portion of a drilling, or a drilling with a uniform diameter, so long as the orifice causes a restriction in flow and therefore a well-defined pressure drop across the orifice. The term 'orifice' is not intended to include an annular clearance between the control valve member and a housing part.

Preferably, the orifice is defined by a drilling. In one embodiment, the orifice is defined by a drilling in a housing part of the fuel injector, for example the valve housing. In another embodiment, the orifice is defined by a drilling in the valve member.

The drain flow path may bypass the first valve chamber. In this advantageous arrangement, fuel flow from the control chamber to the low-pressure drain can be arranged to follow a relatively short path within the injector. For example, the injector may include a service flow path that opens into the control chamber, and that connects both the first valve chamber and the second valve chamber to the control chamber. The service flow path may include or connect with a first branch leading to the first valve chamber to define the second filling flow path, and a second branch leading to the second valve chamber to define the drain flow path. The service flow path may comprise a common passage that opens into the control chamber. In this way, the first and second valve chambers can both be connected to the control chamber through a single opening into the control chamber, thereby minimising the volume of fuel in hydraulic communication with the control chamber in use.

In another arrangement, the drain flow path provides flow from the control chamber to the second valve chamber by way of the first valve chamber when the control valve member is in the second state. In other words, in this arrangement, the drain flow path connects with the first valve chamber.

The control valve member preferably comprises a first seating region which defines, in part, the first valve chamber, and a second seating region which defines, in part, the second valve chamber. Conveniently, the second seating region may comprise an end region of the control valve member.

When the injector includes a housing body having a mating surface that abuts the valve housing, the valve needle may be slidable within the housing body. Preferably, the valve needle seating is defined by the housing body. In alternative arrangements, the housing body may be an intermediate component between the valve housing and a further housing in which the valve needle is slidable and/or which defines the valve needle seating, or one of several such intermediate components.

In one embodiment, the low-pressure drain comprises a drain passage provided in the housing body. In particular, when the drain passage is provided in a housing body within which the valve needle is slidable and, preferably, which defines the valve needle seating, the part count of the injector can be minimised. To this end, the housing body may comprise a nozzle body of the injector. Furthermore, a relatively large-diameter drain passage can be accommodated in the housing body, which can help to optimise the flow behaviour of fuel as it flows into and through the drain passage.

The drain passage may open into the second valve chamber at the mating surface of the housing body. The drain flow path may be arranged to direct fuel flow towards the mating surface of the housing body. Such an arrangement is particularly advantageous when the drain passage opens into the second valve chamber at the mating surface, since the fuel flow can be directed through the second valve chamber and towards the drain passage, improving the flow characteristics of the fuel when the control valve member is in its second state, and reducing the likelihood of cavitation damage or erosion due to turbulent fuel flow. In particular, the fuel flows from the drain flow path to the drain passage along a relatively straight path, free from significant tortuosity or convolution. The drain flow path may for example be inclined towards the mating surface of the housing body, and/or inclined to direct fuel flow towards the drain passage.

The valve needle may be received in an accumulator volume for fuel, and the supply means may comprise a supply passage that extends from the accumulator volume to the control valve to communicate with the first valve chamber when the control valve member is in the first state. Alternatively, the supply means may comprise a supply passage that supplies fuel directly to the control valve member (for example to a space upstream of the first valve chamber) for delivery to the first valve chamber when the control valve member is in the first state.

The first filling flow path may include an orifice to restrict the flow of fuel into the control chamber through the first filling flow path. The orifice in the first filling flow path further improves performance of the injector for substantially the same reasons as described above with respect to the drain restriction. In a particularly advantageous configuration, in which both the first filling flow path and the drain flow path include orifices, the opening rate of the valve needle can be very precisely controlled by suitable sizing of the orifices in the first filling flow path and the drain flow path respectively during manufacture, and consistency between parts and during operation of each individual part is improved.

The first filling flow path may provide a continuous flow of fuel into the control chamber. Fuel flow out of the control chamber may be interruptable, for example when the valve needle has reached a pre-determined lift position. In an alternative configuration, fuel flow through the first filling flow path into the control chamber may be interruptable, for example when the valve needle has reached a pre-determined lift position, as is described in EP 1 988 276 B.

In second, third, fourth, fifth and sixth aspects, the present invention resides in a fuel injector for use in a fuel system for an internal combustion engine, the fuel injector comprising a supply means for high pressure fuel, an injection nozzle including a valve needle which is engageable with a valve needle seating to control fuel delivery from the injector, a surface associated with the valve needle being exposed to fuel pressure within a control chamber, a first filling flow path providing flow from the supply means into the control chamber, and a control valve for controlling fuel pressure within the control chamber, wherein the control valve comprises a first valve chamber and a second valve chamber.

The control valve further comprises a control valve member operable between a first state in which the first valve chamber communicates with the supply means, and in which flow between the second valve chamber and a low-pressure drain is prevented, and a second state in which flow between the first valve chamber and the supply means is prevented, and in which the second valve chamber is in communication with the low-pressure drain.

The fuel injector further comprises a drain flow path including a drain restriction and permitting flow from the control chamber to the second valve chamber when the control valve member is in the second state, and a second filling flow path permitting flow from the first valve chamber into the control chamber when the control valve member is in the first state, wherein the second filling flow path bypasses the drain restriction.

In the second aspect of the invention, the drain flow path bypasses the first valve chamber.

In the third aspect of the invention, the drain restriction comprises an orifice.

In the fourth aspect of the invention, the control valve further comprises a valve housing that defines, in part, the first valve chamber and the second valve chamber, and the control valve member is slidable within a guide bore of the valve housing. The injector further comprises a housing body having a mating surface that abuts the valve housing. The low-pressure drain comprises a drain passage provided in the housing body. Preferably, the valve needle seating is defined by the housing body.

In the fifth aspect of the invention, the control valve further comprises a valve housing that defines, in part, the first valve chamber and the second valve chamber, and the control valve member is slidable within a guide bore of the valve housing. The injector further comprises a housing body having a mating surface that abuts the valve housing. The drain flow path is arranged to direct fuel flow towards the mating surface of the housing body.

In the sixth aspect of the invention, the control valve further comprises a valve housing that defines, in part, the first valve chamber and the second valve chamber, and the control valve member is slidable within a guide bore of the valve housing. The injector further comprises a housing body having a mating surface that abuts the valve housing. The housing body applies a compressive force to a region of the valve housing, and the drain flow path and the second filling flow path are formed within the region of the valve housing to which the compressive force is applied.

Preferred and/or optional features of the first aspect of the invention may be used as appropriate, alone or in combination, in the other aspects of the invention also.

BRIEF DESCRIPTION OF THE DRAWINGS

The present invention will now be described, by way of example only, with reference to the accompanying drawings, in which like reference numerals are used for like features, and in which.

Throughout the following description, terms such as 'upper' and 'lower', and 'upwards' and 'downwards' are used with reference to the orientation of the parts in the accompanying drawings, although it will be appreciated that the parts could have a different orientation in use. Terms such as 'upstream' and 'downstream' are used with reference to the direction of fuel flow in the injector in normal use.

DETAILED DESCRIPTION OF EMBODIMENTS OF THE INVENTION

Figure 1A:
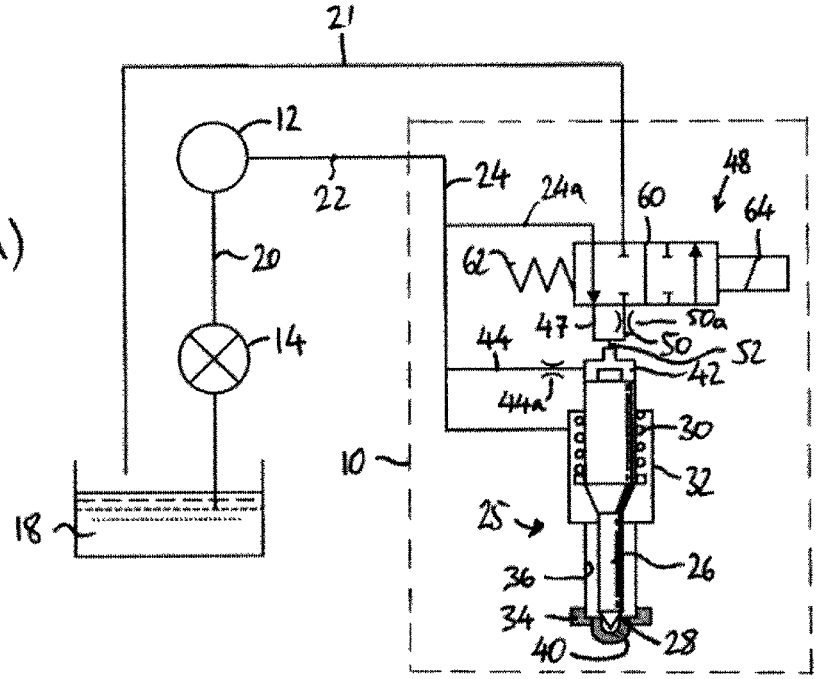
FIGS. 1(*a*) and 1(*b*) are schematic diagrams of a fuel injector according to a first embodiment of the present invention, in a first operating condition and a second operating condition, respectively.
Figure 1B:
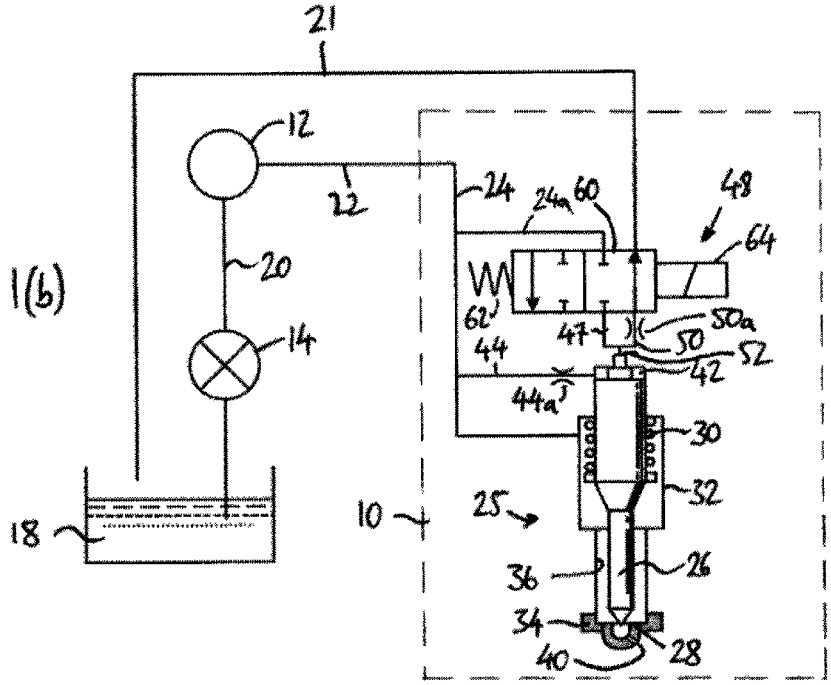

Referring to FIGS. 1(*a*) and 1(*b*), a fuel system for a compression ignition internal combustion engine includes a fuel injector 10 of a first embodiment of the present invention. The injector 10 is arranged to receive high pressure fuel from an accumulator volume or common rail 12, which is charged with fuel at high pressure by means of a high pressure fuel pump 14, typically to a pressure level of 400 to 3000 bar. The fuel pump 14 receives fuel at relatively low pressure from a low pressure fuel reservoir or drain 18 and delivers pressurised fuel to the common rail 12 through a first delivery line 20. The common rail 12 supplies fuel at high pressure (referred to as "supply pressure") through a second delivery line 22, which in turn is arranged to deliver fuel to a supply passage 24 of the injector 10. Fuel is returned from the injector 10 to the drain 18 through a return or drain line 21.

The injector 10 includes an injection nozzle 25 having a valve needle 26, which is urged towards a valve needle seating 28 by means of a valve needle spring 30 housed within a spring chamber 32. The injection nozzle 25 includes a housing body or nozzle body 34 (only a lower end portion of which is shown) provided with a bore 36 within which the valve needle 26 is moveable. The spring chamber 32 is defined at the upper end of the nozzle bore 36. The spring chamber 32 and the bore 36 together define an accumulator volume for fuel within the injector 10, which receives high-pressure fuel from the supply passage 24.

The valve needle 26 has downwardly-facing thrust surfaces exposed to fuel pressure within the bore 36 and the spring chamber 32, and said fuel pressure acting on the thrust surfaces causes an upward force to be applied the valve needle 26 which acts in a valve needle opening direction.

The valve needle 26 is movable into and out of engagement with the valve needle seating 28 to control whether fuel delivered to the nozzle bore 36 is able to flow past the valve needle seating 28 to reach a plurality of outlet openings 40 (only one of which is shown) provided in the nozzle body 34, so that when the valve needle 26 is moved away from the valve needle seating 28, an injection of fuel occurs through the outlets 40 into the associated combustion space (not shown).

At the end of the valve needle 26 remote from the valve needle seating 28, an end surface of the valve needle 26 is exposed to fuel pressure within a control chamber 42. Fuel pressure within the control chamber 42 acts in combination with the valve needle spring force to urge the valve needle 26 against the seating 28.

In another embodiment, the valve needle may be coupled to a needle piston so that it is a surface of the needle piston that is exposed to fuel pressure within the control chamber 42, and not a surface of the valve needle 26 itself.

There are two possible flow paths for fuel into the control chamber 42 from the supply passage 24. A first control chamber filling path 44 is provided between the injector supply passage 24 and the control chamber 42. The first filling flow path 44 permits a continuous flow of fuel into the control chamber 42 at a restricted rate, as determined by a first restriction orifice 44*a* in the first filling flow path 44. A second control chamber filling path 47 is able to supply high pressure fuel to the control chamber 42 under the control of a nozzle control valve 48.

A control chamber drain flow path 50 provides a flow path that permits fuel to flow from the control chamber 42 to the drain line 21. The flow of fuel to the low-pressure drain 18 through the drain flow path 50 is restricted by a restricted drain orifice 50*a* in the drain path 50. The drain flow path 50 is also under the control of the nozzle control valve 48.

The second filling flow path 47 and the drain flow path 50 merge into a common flow path, referred to hereafter as a service flow path or passage 52, which connects both the second filling flow path 47 and the drain flow path 50 to the control chamber 42. In this way, only one passage (the service flow path 52) opens into the control chamber 42 to connect the control chamber 42 to the nozzle control valve 48.

The nozzle control valve 48 takes the form of a three-way control valve 48, which is operable between first and second states or positions. In the first position, shown in FIG. 1(*a*), the second filling flow path 47 communicates with the supply passage 24, by way of a branch 24*a* of the supply passage, while flow between the drain flow path 50 and the drain line 21 is prevented (i.e. communication between the drain flow path 50 and the drain line 21 is blocked). In the second position, shown in FIG. 1(*b*), flow between the supply passage 24 and the second filling flow path 47 is prevented or blocked, while the drain flow path 50 communicates with the drain line 21. In this way, the control valve 48 is operable to determine whether fuel pressure in the control chamber 42 increases or decreases.

The nozzle control valve 48 includes a nozzle control valve member 60 and a control valve spring 62, which serves to bias the nozzle control valve member 60 into the first position. An electromagnetic actuator, identified generally by 64, is operable to move the nozzle control valve member 60 into the second position, against the control valve spring force. The electromagnetic actuator 64 is of conventional type and includes an energisable winding (not shown in FIGS. 1(*a*) and 1(*b*)) through which a current is supplied when it is required to open the nozzle control valve 48 to commence injection, as discussed further below.

The service passage 52 has a single entry port or opening to the control chamber 42. The upper end of the valve needle 26 is co-operable with the entry port in circumstances in which the valve needle 26 is moved away from its seating 28 through a predetermined amount, being its maximum extent of travel ("maximum lift"). Co-operation between the end of the valve needle and the entry port of the service passage 52 provides a means of reducing loss of high pressure fuel from the first filling flow path 44, by way of the control chamber 42, during an injection event.

Operation of the fuel system so as to provide an injection of the fuel through the outlets 40 will now be described in detail. In the position shown in FIG. 1(*a*), the nozzle control valve 48 is in the first position and there is a supply of high pressure fuel into the control chamber 42 through both the first filling flow path 44 and the second filling flow path 47, due to the second filling flow path 47 communicating with the supply passage 24 through the control valve 48. Communication between the control chamber 42 and the return line 21, via the drain flow path 50, is broken. High fuel pressure within the control chamber 42 acts in combination with the force of the valve needle spring 30 and serves to urge the valve needle 26 into engagement with its seating 28 to prevent injection through the outlet openings 40. This is the non-injecting state of the fuel injector.

When it is required to commence injection, the actuator 64 is energised to move the nozzle control valve 48 into its second position against the force of the control valve spring 62. Movement of the nozzle control valve 48 into its second position closes communication between the injector supply passage 24 and the control chamber 42 through the second filling flow path 47 and opens communication between the control chamber 42 and the return line 21 through the drain flow path 50 and the restricted drain orifice 50*a*. In such circumstances, fuel within the control chamber 42 is able to flow from the control chamber 42, through the drain flow path 50 to the return line 21 and, hence, to low pressure, causing a reduction in fuel pressure in the control chamber 42.

As fuel pressure within the control chamber 42 is reduced, the closing force acting on the upper end of the valve needle 26 is reduced. As a consequence, the valve needle 26 is caused to move away from its seating 28 due to high fuel pressure delivered to the nozzle bore 36 acting on the injector thrust surfaces in the valve needle opening direction. Fuel is therefore able to flow through the outlet openings 40 into the engine cylinder. This is the injecting state of the fuel system, as shown in FIG. 1(*b*).

During the injection phase, fuel pressure within the control chamber 42 will drop to an intermediate level between low pressure (i.e. drain pressure) and supply pressure (i.e. pressure within the supply passage 24). The level to which fuel pressure within the control chamber 42 is reduced is determined by the ratio of the flow areas presented by the restriction 44*a* in the first filling flow path 44 (through which fuel flows into the control chamber 42) and the restricted drain orifice 50*a* in the drain flow path 50 (through which fuel flows to low pressure). These restrictions 44*a*, 50*a* are sized to ensure that, when the nozzle control valve 48 is open, pressure in the control chamber 42 is allowed to reduce at least to a level (the threshold pressure level) which, in combination with the valve needle spring force, is overcome by the upwardly directed forces acting on the valve needle 26. Thus, at some time after the nozzle control valve 48 has moved into its second position, the valve needle 26 will lift away from its seating 28 to allow injection to commence. Once pressure in the control chamber 42 drops to the threshold pressure level, the rate at which fuel pressure within the control chamber 42 is reduced further determines the rate at which the valve needle 26 is caused to lift away from its seating.

In particular, the restricted drain orifice 50*a* serves to reduce the outflow of fuel from the control chamber 42, which ensures that the opening movement of the valve needle 26 is relatively slow and controlled.

When the valve needle 26 is at maximum lift, the end of the valve needle 26 covers the entry port of the service passage 52 into the control chamber 42, thereby breaking communication between the first filling flow path 44 and the drain line 21 and avoiding unnecessary loss of fuel to drain.

To terminate injection, the nozzle control valve 48 is returned to its first position by de-energising the actuator winding. Moving the nozzle control valve 48 into its first position closes communication between the control chamber 42 and the return line 21 via the drain flow path 50 and instead opens communication between the second filling flow path 47 and the supply passage 24 so that fuel is able to flow into control chamber 42 through the nozzle control valve 48. High pressure is therefore re-established within the control chamber 42 due to the flow of fuel through the first filling flow path 44 (which is continuous in this embodiment) and the additional flow of fuel through the second filling flow path 47. With high fuel pressure re-established in the control chamber 42, the valve needle 26 is substantially pressure balanced, and the valve needle spring 30 therefore serves to urge the valve needle 26 against the valve needle seating 28 to terminate injection.

Advantageously, the flow of fuel into the control chamber 42 at the end of injection is relatively high, due to the two filling flow paths between the supply passage 24 and the control chamber 42 (*i*) through the continuous first filling flow path 44 and (ii) through the second filling flow path 47 that is controlled by the control valve. This results in a relatively high rate of closing movement of the valve needle 26.

It is a feature of this embodiment of the invention that the flow of fuel into the control chamber 42 via the second filling flow path 47 bypasses the restricted drain orifice 50*a* in the drain flow path 50. This arrangement means that the respective rates of fuel flow through the second filling flow path 47 and through the drain flow path 50 can be independently selected. Advantageously, therefore, fuel flow into the control chamber 42 through the second filling flow path 47 when the control valve 48 is in its first position can be relatively high to assist in rapid valve needle closure, whilst fuel flow out of the control chamber 42 through the drain flow path 50 and the restricted drain orifice 50*a* when the control valve 48 is in its second position can be relatively low to damp opening movement of the valve needle 26.

The characteristics of the injector 10, for example injection timing (e.g. relative to pumping), rate of movement of the valve needle 26 and fuel delivery quantity can be optimised by careful selection of the flow areas of the restrictions 44*a*, 50*a* in the first filling flow path and in the drain flow path, 44, 50 respectively, along with the pre-load of the valve needle spring 30 and the diameter of the valve needle seating 28.

It is a particular benefit of this embodiment of the present invention that the restriction 50*a* in the drain flow path 50 is in the form of an orifice, i.e. a restricted-diameter drilling or bore with a well-defined cross-sectional flow area, rather than being defined by an annular clearance between parts or by surface flats on the valve needle. By providing the restriction 50*a* as an orifice, the flow area of the orifice 50*a* and therefore the extent to which flow through the drain flow path 50 is restricted can be very precisely controlled during manufacture, improving the accuracy of the injector and the consistency of performance part-to-part. Furthermore, the pressure drop through an orifice is relatively insensitive to temperature, so by providing the drain restriction in the form of an orifice 50*a* the variation of injector performance with temperature changes in use can be minimised.

In the embodiment of FIGS. 1(*a*) and 1(*b*), the restriction 44*a* in the first filling flow path 44, through which fuel flows into the control chamber 42, is also embodied as an orifice, with the same benefits as described above. In this particularly advantageous configuration, the opening rate of the valve needle 26 can be very precisely controlled by suitable sizing of the orifices during manufacture, and consistency between parts and during operation of each individual part is improved.

Figure 2:
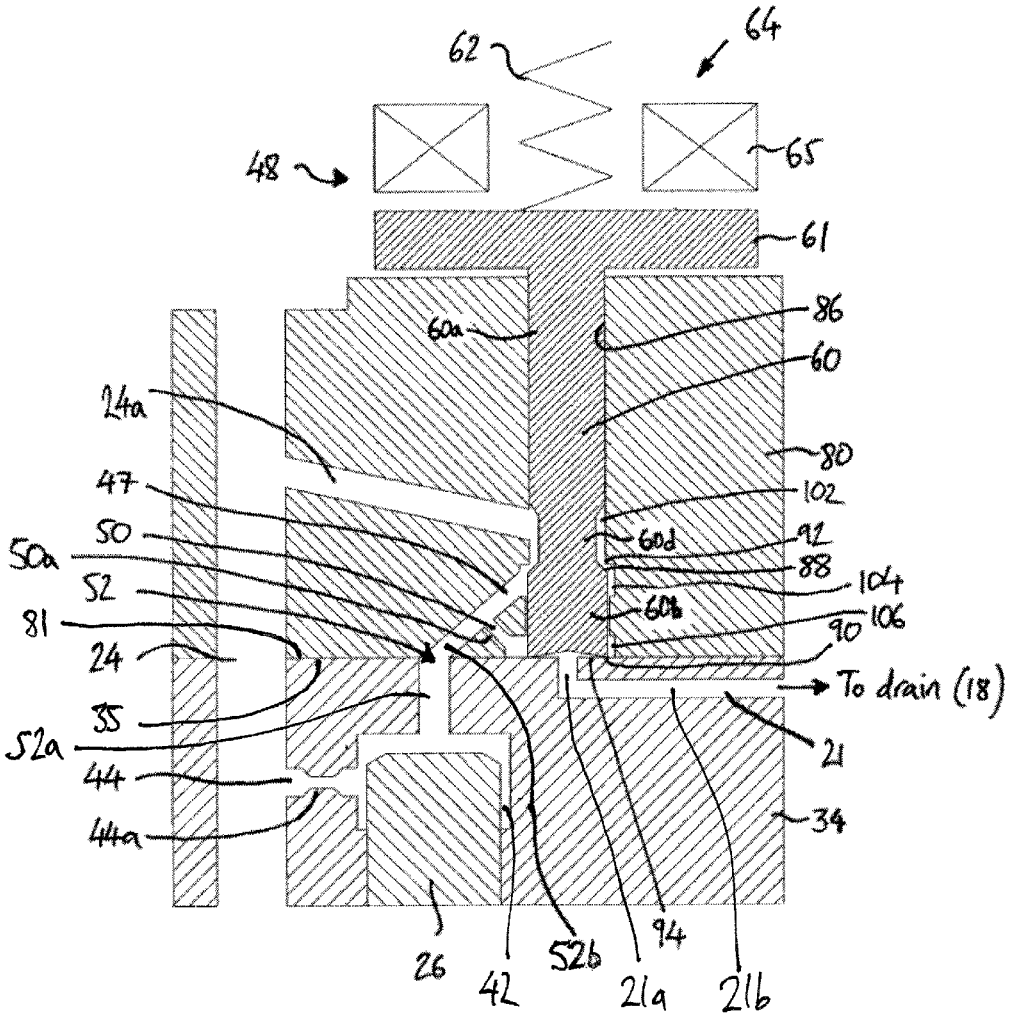
FIG. 2 is a cross-sectional view of part of a fuel injector of the type illustrated in FIGS. 1(*a*) and 1(*b*)

The injector 10 is preferably formed such that the injection nozzle 25 and the nozzle control valve 48 form part of the same injector unit 10. By way of example, FIG. 2 shows one practical embodiment of a part of the injector 10 shown in FIGS. 1(*a*) and 1(*b*). Similar parts to those shown in FIGS. 1(*a*) and 1(*b*) have been referred to with like reference numerals for ease of reference.

Referring to FIG. 2, the injector 10 includes a valve housing 80 that houses the nozzle control valve member 60 and abuts the upper end of the nozzle body 34. The valve needle 26 is slidable within a bore in the nozzle body 34, and the valve needle seating (not shown in FIG. 2) is defined by the nozzle body 34 at a lower end of the bore. The valve housing 80 and the nozzle body 34 are provided with drillings, which together define part of the injector supply passage 24. The nozzle body 34 has a mating face 35 which abuts a mating face 81 of the valve housing 80. In the assembled injector, the nozzle body 34 and the housing 80 are clamped together by a cap nut (not shown), so that a seal is formed between the respective mating faces 35, 81.

The first filling flow path 44 is defined by a first drilling provided in the nozzle body 34 so as to communicate with the injector supply passage 24 at one end and the control chamber 42 at its other end. A restricted-diameter portion or restricted orifice 44*a* in the first filling flow path 44 provides an accurately-defined restriction to fuel flow through the first filling flow path 44. A second drilling 52*a* is provided in the nozzle body 34 to define, together with a drilling 52*b* in the valve housing 80, the service passage 52. Within the valve housing 80, the service passage 52 splits into two branches to form the second filling flow path 47 and the drain flow path 50, as will be explained in more detail below.

The nozzle body 34 is also provided, towards its upper end, with a third drilling which forms a part of the return line 21 to the low pressure drain 18. A first part 21*a* of the return line 21 extends from the mating face 35 into the nozzle body 34 and is coaxial with the nozzle control valve member 60. A second part 21*b* of the return line 21 extends radially outwards through the nozzle body 34 to connect with further drain passages (not shown). The actuator 64 includes an electromagnetic winding 65, a spring 62 (as shown in FIGS. 1 and 2) and an armature 61 which is actuable in response to energisation and de-energisation of the winding 65. It should be noted that one difference between the embodiment of FIGS. 1(*a*) and 1(*b*) and the embodiment in FIG. 2 is that in FIGS. 1(*a*) and 1(*b*) the actuator 64 is of the 'energise-to-push' type (i.e. energising the winding of the actuator causes the nozzle control valve member to be pushed against the spring force), whereas in FIG. 2 the actuator 54 is of the 'energise-to-pull' type.

The nozzle control valve member 60 is coupled to the armature 61. As shown in FIG. 2, the upper valve housing 80 is provided with a valve housing bore 86. The nozzle control valve member 60 includes an upper guide region 60*a*, being that region coupled to the armature 61, and a lower region 60*b* having an upwardly-facing frusto-conical surface at its upper end. A valve neck 60*d* separates the upper guide region 60*a* from the lower region 60*b*. The upper guide region 60*a* is guided for movement within the valve housing bore 86.

The lower region 60*b* of the nozzle control valve member 60 includes an upper seating region or seating surface 88 which is defined on the upper frusto-conical surface. An end surface of the valve member 60 is shaped with a shallow substantially conical recess to define a lower seating region or seating line 90 at the periphery of the recess. A region of the valve housing bore 86 is shaped to define an upper valve seat 92 for engagement with the upper seating surface 88 of the nozzle control valve member 60 when in its second position. The lower seating line 90 is engageable with a flat, lower valve seat 94 defined by the mating face 35 of the nozzle body 34 when the control valve member 60 is in its first position.

A drilling 24*a* in the valve housing 80 conveys fuel from the supply passage 24 to an annular space or gallery 102 formed around the neck region 60*d* of the control valve member 60. The annular space 102 lies upstream of the upper seating surface 88. Two valve chambers are provided around, and are defined in part by, the lower region 60*b* of the valve member 60. A first or upper valve chamber 104, comprising an annular gallery, is located downstream of the upper seating surface 88. A second or lower valve chamber 106, comprising a further annular gallery, is located upstream of the lower seating line 90.

Between the first and second valve chambers 104, 106, the lower region 60*b* of the valve member 60 is a close sliding fit within the bore 86. Whilst some leakage flow between the first and second valve chambers 104, 106 can be expected at the sliding interface between the valve member 60 and the bore 86, there is no substantial fuel flow through this path.

The second filling flow path 47 is in the form of a passage or drilling in the valve housing 80 that branches or extends from the service passage 52 at one end to the first valve chamber 104. The drain flow path 50 is in the form of a further passage or drilling in the valve housing 80 that branches or extends from the service passage 52 at one end to the second valve chamber 106. The drain flow path 50 includes a restriction 50*a* in the form of a restricted-diameter portion or orifice in the drain flow path 50, which provides an accurately-defined restriction to fuel flow through the drain flow path 50.

As will be appreciated from FIG. 2, the second filling flow path 47, the drain flow path 50 and the upper part 52*b* of the service passage 52 are located in a region of the valve housing 80 close to the mating face 81. Because the nozzle body 34 and the valve housing 80 are clamped together, in the assembled injector the region of the valve housing 80 in which the second filling flow path 47 and the drain flow path 50 are located is held under compression. Advantageously, therefore, the second filling flow path 47 and the drain flow path 50 are able to accommodate fuel at higher pressures than would otherwise be the case without the risk of failure.

In particular, in this embodiment, the branching point at which the second filling flow path 47 and the drain flow path 50 branch from the service passage 52 is located within this compressively-loaded region of the valve housing 80. This arrangement is particularly beneficial in minimising the risk of component failure, since the stresses acting on the valve housing 80 due to fuel pressure are greatest at this branching point.

The part 52*b* of the service passage 52 that extends within the valve housing 80 is inclined with respect to the longitudinal axis of the injector. In other words, this part 52*b* of the service passage 52 extends upwardly from the mating face 81 and also inwardly, towards the control valve member 60. The second filling flow path 47 is coaxial with this inclined portion of the service passage 52. The drain flow path 50 is also inclined with respect to the mating surface 35 of the nozzle body 34 and the longitudinal axis of the injector, and extends both downwardly from the service passage 52 and inwardly towards the second valve chamber 106.

The nozzle control valve member 60 is biased by means of the spring 62 into the first position (downwards in the orientation shown) in which the lower seating line 90 of the nozzle control valve member 60 is in engagement with the lower valve seat 94. In such circumstances, fuel is able to flow from the injector supply passages 24, 24*a* into the annular space 102, past the unseated upper valve seat 88, 92 and through the second filling flow path 47 and the service passage 52 to the control chamber 42. Since flow to the drain line 21 is blocked by the control valve member 60 at the lower seating line 90, no fuel flows through the drain flow path 50 to drain 18.

Importantly, flow from the supply passage 24 through the second filling flow path 47 towards the control chamber 42 bypasses the drain flow path 50, so that fuel flow into the control chamber 42 is not restricted by the restricted drain orifice 50*a*.

In addition to the flow of fuel through the second filling flow path 47, fuel is also able to flow into the control chamber 42 through the first filling flow path 44. This is the stage of the injection cycle in which the valve needle 26 is seated and injection does not take place due to high fuel pressure within the control chamber 42.

In order to move the nozzle control valve member 60 into its second position (upwards in the orientation shown), the actuator winding 65 is energised to cause the lowermost end of the nozzle control valve member 60 to move away from the lower valve seat 94, and to move the upper seating surface 88 into engagement with the upper valve seat 92. In such circumstances, communication between the supply passages 24, 24*a* and the second filling flow path 47 is broken and instead communication is established between the control chamber 42 and the return line 21 through the drain flow path 50. Fuel within the control chamber 42 escapes to low pressure through the drain flow path 50 at a greater rate than fuel flows into the control chamber 42 through the first filling flow path 44 and, hence, the valve needle 26 is caused to lift from its seating. During this stage of operation, fuel pressure within the control chamber 42 drops to an intermediate level between supply pressure and drain pressure.

In this embodiment, fuel flows from the control chamber 42 to drain 18 by way of the service passage 52, the drain flow path 50 (through the restricted drain orifice 50*a*), and into the drain line 21 by way of the second valve chamber 106. The drain flow path 50 therefore bypasses the first valve chamber 104, which keeps the length of the flow path to drain relatively short and so improves the responsiveness of the injector.

Also, the inclined arrangement of the drain flow path 50 helps to direct fuel flow towards the mating surface 35 of the nozzle body 34 that is exposed in the second valve chamber 106 when the control valve member 60 is lifted from its lower valve seat 64. In this way, fuel is encouraged to flow through the second valve chamber 106 along a direct path towards the outlet to the drain line 21. This arrangement helps to reduce the likelihood of cavitation in the fuel flowing to drain and therefore reduces the possibility of damage to the injector components.

Figure 3:
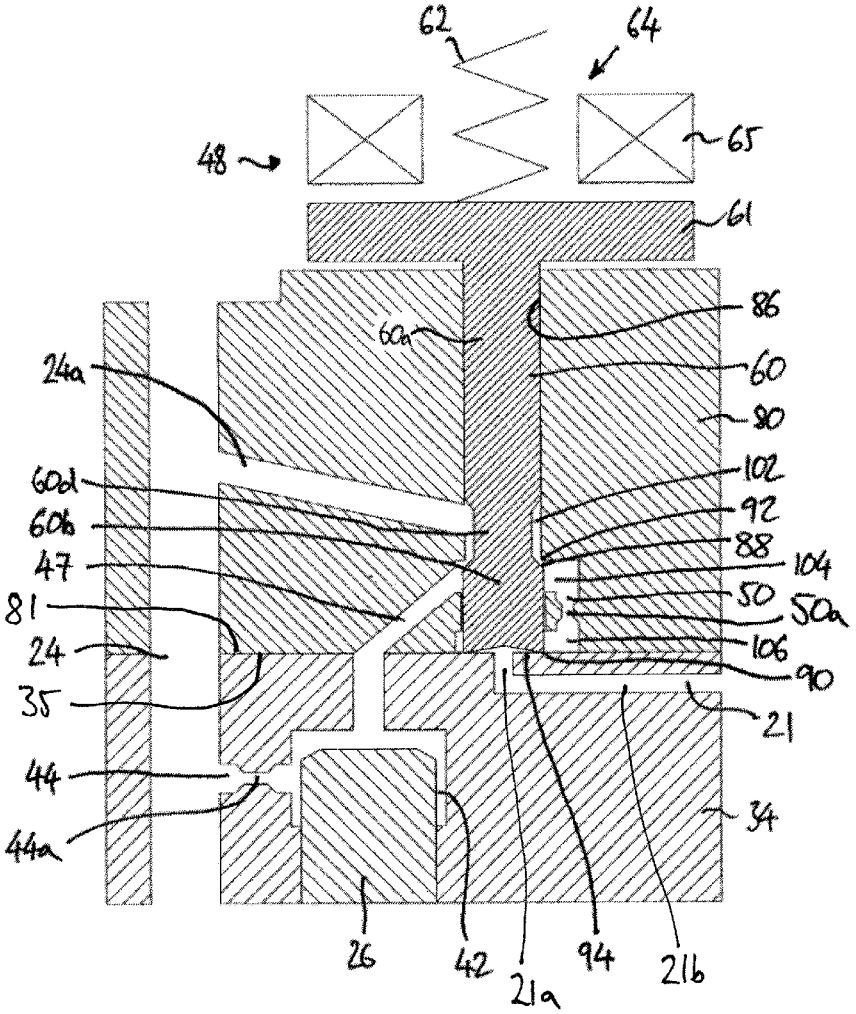
FIG. 3 is a cross-sectional view of part of a fuel injector according to a second embodiment of the present invention.

FIG. 3 shows an alternative practical embodiment to that shown in FIG. 2, in which like or equivalent parts are identified with like reference numerals. As in FIG. 2, the actuator 54 in FIG. 3 is of the 'energise-to-pull' type. The injector of FIG. 3 differs from that of FIG. 2 in the arrangement of passages that connect to the first and second valve chambers 104, 106.

In the embodiment shown in FIG. 3, the control chamber 42 is connected to the first valve chamber 104 by drillings in the nozzle body 34 and the valve housing 80 that define the second filling flow path 47. Unlike in the FIG. 2 embodiment, in this embodiment there is no branched service passage. Instead, the second filling flow path 47 connects directly to the control chamber 42, and the drain flow path 50 is defined by a drilling that extends upwardly from the lower end of the valve housing 80 to connect the first and second valve chambers 104, 106. The restricted drain orifice 50*a* comprises a restricted diameter portion of the drain flow path drilling 50.

Operation of the nozzle control valve 48 in the FIG. 3 embodiment is similar to that described previously for FIGS. 1(*a*), 1(*b*) and 2. To initiate injection, the nozzle control valve member 60 is moved into its second position by energising the actuator winding 65. When in the second position, the upper seating surface 88 is moved into engagement with the upper valve seat 92, and the lower seating line 90 disengages from the lower seating surface 94. In this configuration, fuel within the control chamber 42 can flow to the return line 21 by way of the second filling flow path 47 (in a direction opposite to the flow direction during filling of the control chamber 42), the first valve chamber 104, the drain flow path 50 and the restricted drain orifice 50*a*, the second valve chamber 106, and then finally past the disengaged lower seating line 90 and lower seating surface 94.

Unlike in the embodiment of FIG. 2, in this FIG. 3 embodiment the flow of fuel to drain 21 passes through, and so does not bypass, the first valve chamber 104.

To terminate injection, the actuator winding 65 is de-energised and the nozzle control valve 60 moves under the action of the control valve spring 62 into the first position in which the lower seating line 90 engages the lower valve seat 94 to close the flow path to the drain line 21. Instead, fuel is able to flow from the supply passages 24, 24*a* into the annular space 102, then past the upper valve seat 88 into the first valve chamber 104 and from there into the control chamber 42 through the second filling flow path 47. As in the embodiment of FIG. 2, in this FIG. 3 embodiment the flow of fuel from the supply passages 24, 24*a* to the control chamber 42 is not restricted by the restricted drain orifice 50*a*.

Figure 4:
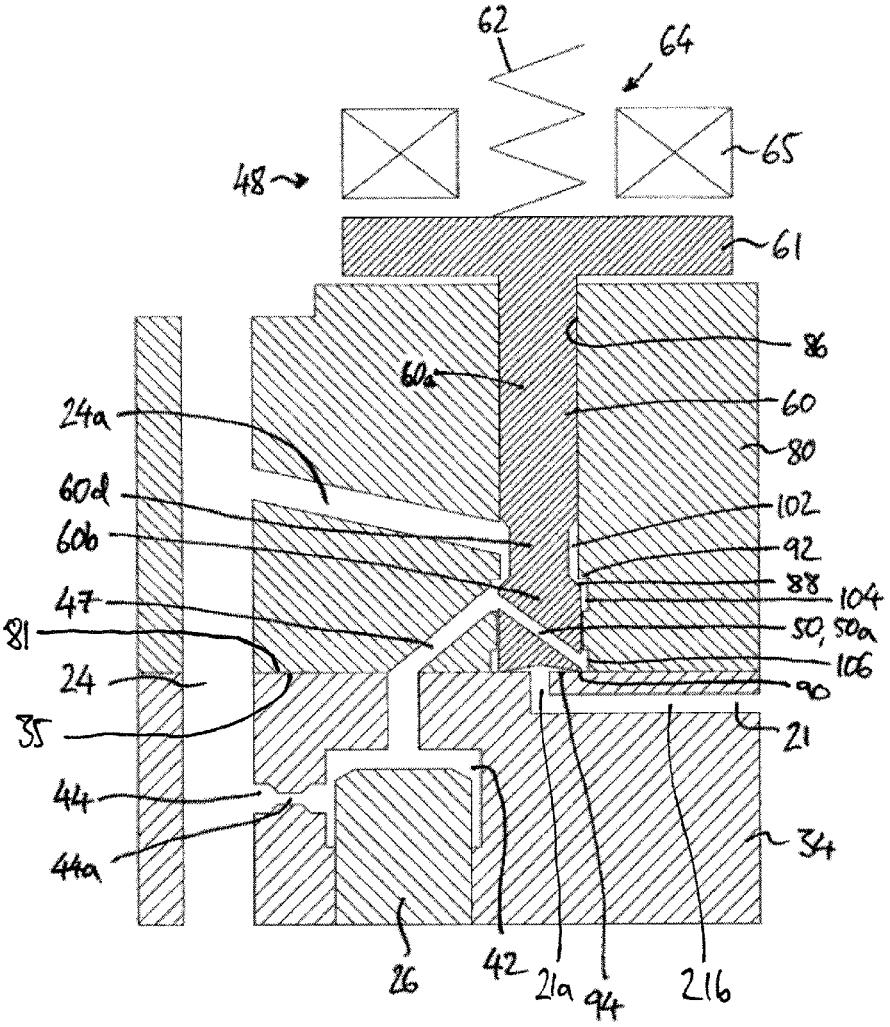
FIG. 4 is a cross-sectional view of part of a fuel injector according to a third embodiment of the present invention.

FIG. 4 shows another alternative practical embodiment to that shown in FIGS. 2 and 3, in which like or equivalent parts are identified with like reference numerals. As in FIGS. 2 and 3, the actuator 54 in FIG. 4 is of the 'energise-to-pull' type. The injector of FIG. 4 is very similar to that of FIG. 3, but differs in the arrangement of the drain flow path 50 that extends between the first and second valve chambers 104, 106.

In the embodiment shown in FIG. 4, the drain flow path 50 is defined by an inclined drilling that extends through the lower region 60*b* of the control valve member 60. The drain flow path 50 opens into the first valve chamber 104 at its upper end, and into the second valve chamber 106 at its lower end, so as to provide fluid communication between the two chambers. The restricted drain orifice 50*a* is defined by a restricted diameter portion of the drain flow path drilling 50 (in FIG. 4, the restricted drain orifice 50*a* extends the whole length of the drain flow path drilling 50).

Operation of the nozzle control valve 48 in the FIG. 4 embodiment is as described previously for FIG. 3. In particular, when the valve member 60 is moved into its second position, fuel within the control chamber 42 can flow to the return line 21 by way of the second filling flow path 47 (in a direction opposite to the flow direction during filling of the control chamber 42), the first valve chamber 104, the drain flow path 50 (and drain orifice 50*a*) through the valve member 60, the second valve chamber 106, and then finally past the disengaged lower seating line 90 and lower seating surface 94.

It will be apparent from the above description that the drain flow path 50 and the second filling flow path 47 do not necessarily need to be in the form of passages that connect directly to the control chamber 42 and/or the respective control valve chambers 104, 106, but that other connecting passages (such as the service passage 52 in FIG. 2) may be present. Other arrangements of passages not explicitly described above can also be contemplated without departing from the scope of the present invention.

It will be appreciated that a three-way nozzle control valve of alternative construction may be used to provide the same function as described previously, without departing from the scope of the present invention. It will be understood that the first and second valve chambers, for example, need not be embodied as annular galleries arranged around the valve member, but could instead be any suitable space arranged to interact with the control valve member in the manner described, and the term 'chamber' should therefore be interpreted broadly.

In FIGS. 2, 3 and 4, the nozzle body 34 and the valve housing 80 are shown as single-piece components. It will be appreciated, however, that other arrangements are possible in which two or more abutting nozzle body and/or valve housing components are provided for receiving the valve needle or the control valve member, respectively. Further arrangements are possible in which one or more intermediate housing body components, such as shim plates or spacers, are provided between the nozzle body and the valve housing. In each case, each of the flow passages within the injector may extend through one body, housing or intermediate component, or through more than one body, housing and/or intermediate component as appropriate.

In the illustrated embodiments, the supply means for high pressure fuel comprises a supply passage that supplies fuel directly to the control valve (i.e to the annular space upstream of the first valve chamber). In an alternative arrangement, the valve needle may be received in an accumulator volume for fuel, and the supply means may comprise a supply passage that extends from the accumulator volume to the control valve. In other words, high-pressure fuel may be supplied to the control valve either directly or by way of an accumulator volume within the injector.

As an alternative to providing an electromagnetic actuator to control the nozzle control valve, another type of actuator may be used, for example a piezoelectric actuator.

Further variations and modifications not explicitly described above will also be apparent to a person skilled in the art, without departing from the scope of the invention as defined by the appended claims.

The invention claimed is:

1. A fuel injector for use in a fuel system for an internal combustion engine, the fuel injector comprising: a supply means for providing a high pressure fuel; an injection nozzle including a valve needle which is engageable with a valve needle seating to control fuel delivery from the injector, a surface associated with the valve needle being exposed to fuel pressure within a control chamber; a first filling flow path providing flow from the supply means into the control chamber; and a control valve for controlling fuel pressure within the control chamber wherein the control valve comprises a valve housing that defines, in part, a first valve chamber and a second valve chamber, and a control valve member slidable within a guide bore of the valve housing and operable between: (i) a first state in which the first valve chamber communicates with the supply means, and in which flow between the second valve chamber and a low-pressure drain is prevented; and (ii) a second state in which flow between the first valve chamber and the supply means is prevented, and in which the second valve chamber is in communication with the low-pressure drain; and wherein the fuel injector further comprises: a drain flow path including a drain restriction and permitting flow from the control chamber to the second valve chamber when the control valve member is in the second state, and a second filling flow path permitting flow from the first valve chamber into the control chamber when the control valve member is in the first state, wherein the second filling flow path bypasses the drain restriction; wherein the drain flow path and the second filling flow path are formed within the valve housing.

2. A fuel injector according to claim 1, wherein the drain restriction comprises an orifice.

3. A fuel injector according to claim 2, wherein the orifice is defined by a drilling in the valve housing.

4. A fuel injector according to claim 1, wherein the drain flow path bypasses the first valve chamber.

5. A fuel injector according to claim 4, comprising a service flow path which opens into the control chamber and connects both the first valve chamber and the second valve chamber to the control chamber.

6. A fuel injector according to claim 5, wherein the service flow path connects with a first branch leading to the first valve chamber to define the second filling flow path, a second branch leading to the second valve chamber to define the drain flow path, and comprises a common passage that opens into the control chamber.

7. A fuel injector according to claim 1, further comprising a housing body having a mating surface that abuts the valve housing, and wherein an end region of the control valve member is engagable with the mating surface of the housing body to prevent flow between the second valve chamber and the low-pressure drain when the control valve member is in its first state.

8. A fuel injector according to claim 7, wherein the valve needle (26) is slidable within the housing body.

9. A fuel injector according to claim 8, wherein the valve needle seating is defined by the housing body.

10. A fuel injector according to claim 7, wherein the low-pressure drain comprises a drain passage provided in the housing body.

11. A fuel injector according to claim 10, wherein the drain passage opens into the second valve chamber at the mating surface of the housing body.

12. A fuel injector according to claim 7, wherein the drain flow path is arranged to direct fuel flow towards the mating surface of the housing body.

13. A fuel injector according to claim 12, wherein the drain flow path is inclined towards the mating surface of the housing body.

14. A fuel injector according to claim 7, wherein the housing body applies a compressive force to a region of the valve housing, and wherein the drain flow path and the second filling flow path are formed within the region of the valve housing to which the compressive force is applied.

15. A fuel injector according to claim 1, wherein the first filling flow path includes an orifice to restrict the flow of fuel into the control chamber through the first filling flow path.

* * * * *